US005735099A

United States Patent [19]

Anderson

[11] Patent Number: 5,735,099

[45] Date of Patent: Apr. 7, 1998

[54] LOG SIDING

[75] Inventor: Ted M. Anderson, Minneapolis, Minn.

[73] Assignee: Western Log and Lumber, Minneapolis, Minn.

[21] Appl. No.: 553,796

[22] Filed: Oct. 23, 1995

[51] Int. Cl.[6] ..... E04F 13/08

[52] U.S. Cl. ..... 52/539; 52/521; 52/592.4; 52/748.11

[58] Field of Search ..... 52/233, 311.2, 52/313, 520, 536, 539, 553, 592.4, 573.1, 748.1, 521, 533, 592.1, 748.11

[56] References Cited

U.S. PATENT DOCUMENTS

| | | | |
|---|---|---|---|
| Re. 1,541 | 9/1863 | Baker | 52/539 |
| 128,896 | 7/1872 | Murray | 52/539 |
| 283,012 | 8/1883 | Morton et al. | 52/520 X |
| 1,654,120 | 12/1927 | Ewing | 52/233 |
| 1,942,348 | 1/1934 | Ward | 52/539 X |
| 2,040,110 | 5/1936 | Tahvonen et al. . | |
| 2,152,694 | 4/1939 | Hoover | 52/592.4 X |
| 3,200,553 | 8/1965 | Frashour et al. | 52/592.4 |
| 4,012,876 | 3/1977 | Grubbs . | |
| 4,115,969 | 9/1978 | Napier | 52/233 |
| 4,288,954 | 9/1981 | O'Donnell | 52/313 X |
| 4,305,238 | 12/1981 | Harward et al. . | |
| 4,878,329 | 11/1989 | Berge . | |
| 4,955,169 | 9/1990 | Shisko | 52/536 |
| 5,060,432 | 10/1991 | Christian | 52/233 |
| 5,163,259 | 11/1992 | Hunsaker et al. . | |
| 5,271,878 | 12/1993 | Mizia et al. . | |
| 5,423,153 | 6/1995 | Wollems et al. . | |
| 5,475,960 | 12/1995 | Lindal | 52/233 X |

FOREIGN PATENT DOCUMENTS

| | | | |
|---|---|---|---|
| 77023361 | 10/1978 | Australia | 52/233 |
| 240737 | 6/1946 | Switzerland | 52/539 |
| 1292 | 4/1875 | United Kingdom | 52/539 |
| 5205 | 4/1888 | United Kingdom | 52/539 |
| 237460 | 7/1925 | United Kingdom | 52/539 |

*Primary Examiner*—Michael Safavi
*Attorney, Agent, or Firm*—Arnold, White & Durkee; Jonathan D. Spangler

[57] ABSTRACT

An improved log siding system capable of providing an improved water-shed between the individual log siding members as attached to a building. A moisture seal junction and a flex gap are formed between each adjacently disposed log siding member. Each moisture seal junction extends from the lower longitudinal edge of the exterior surface of each log siding member upward (vertically or angled inward) toward the respective flex gap, which extends therefrom toward the interior surface of the log siding members. The interspacing of each flex gap, in conjunction with a release cut formed in the interior surface of each log siding member, varies in response to structural deformations experienced by the log siding members due to variations in moisture content and/or temperature so as to maintain flush seal of each moisture seal junction. This effectively thwarts the ingress of moisture behind the log siding members so as to reduce the likelihood of swelling, rotting, and cracking over time.

31 Claims, 12 Drawing Sheets

LOG SIDING

BACKGROUND OF THE INVENTION

I. Field of the Invention

This invention relates generally to log siding for use on homes, cabins, or other structures. More particularly, the present invention relates to a log siding having an improved interlocking configuration along the longitudinal borders thereof to provide a moisture-proof junction between the log siding members when disposed in vertically adjacent relationship on the exterior and/or interior of said structures. Moreover, this improved interlocking configuration allows the log siding members of the present invention to be attached in a blind-nail fashion so as to provide an outwardly facing round-log appearance that is free from unsightly nail heads.

II. Discussion of the Prior Art

In an effort to replicate the outward appearance of a stacked log construction, such as a log cabin, builders have for years worked towards producing a low-cost wood log siding that can be mounted on conventionally built stud framed structures having typical vapor barrier, insulation, wall framing, exterior sheathing, and building wrap. Traditionally, such log siding comprises a half-log (simulated or real) constructed in either a shiplap or a tongue-and-groove configuration for attachment to the exterior of the structure. The shiplap configuration is typified where the log siding is rabbeted along a longitudinal edge to form a flush joint between the vertically adjacent log siding members. The tongue-in-groove configuration is characterized by a tongue and a matching groove disposed on opposing longitudinal edges of the log siding for interlocking the vertically adjacent log siding members. However, significant problems exist with the prior art attempts to produce such log siding, especially with regard to the joints or seams formed between the vertically adjacent log siding members. In a typical tongue and groove configuration, for instance, moisture has a tendency to seep within the vertically adjacent log siding members which ultimately causes the wood to rot, swell, and/or crack due to warping. A similar problem exists in a ship-lap configuration, wherein the log siding members must be face nailed to the structure, thereby exposing a nail head on the outwardly facing viewing surface.

U.S. Pat. No. 4,012,876 to Grubbs represents an early attempt at solving the above-mentioned problems. Grubbs provides half log siding of shiplap configuration having matching rabbets formed along each longitudinal edge. A filler strip having opposing flange portions is disposed in between the vertically adjacent log siding members such that the flange portions engage with the matching rabbets to provide a moisture-proof seal. However, the upper rabbet of each half log siding opens upwards, thereby increasing the likelihood that moisture will infiltrate the moisture-proof seal to cause rotting and possible damage to the underlying structure. Additionally, the required filler strip consumes a substantial amount of space along the surface of the structure, thereby detracting from the "natural" look of a log construction.

U.S. Pat. No. 5,423,153 to Woolems et al. is another ill attempt at providing a moisture-proof junction between vertically adjacent log siding members. Woolems et al. provides a wood log siding of shiplap configuration having a curved exterior surface bounded by a vertical rail at the upper longitudinal edge and a matched notch along the lower longitudinal edge. However, a nail is required to be driven through the exterior surface of the log siding proximate the lower longitudinal edge to accomplish the desired moisture-proof seal. In so doing, an unsightly nail head remains outwardly exposed on the exterior surface of the log siding, thereby marring the aesthetics of the outward visual appearance. Another potential problem exists in that, over time, moisture may seep into the area of the resultant nail hole, thereby increasing the risk that the log siding will experience rot, swelling or cracking.

Referring to FIG. 1, shown is yet another attempt at producing a moisture-proof seal between vertically adjacent log siding members. This attempt employs an interlocking tongue-and-groove configuration that is commonly used in siding applications. In this arrangement, each vertically adjacent siding member 2 has a tongue 4 and a groove 6 disposed on the upper and lower longitudinal edges, respectively. During construction, tongue 4 and groove 6 of each siding member 2 cooperate interlockingly to ensure the proper vertical engagement and alignment of the siding members 2. In order to eliminate an outwardly exposed nail head, as found in the Woolems reference, a nail 8 is driven angularly through the upper horizontal surface of each siding member 2 proximate the tongue 4 so as to affix the given siding member to the interior structure 10. However, this tongue and groove arrangement results in a horizontal junction 12 formed between each adjacent siding member 2 which permits condensation to seep inward toward the base of the tongue 4. This increases the likelihood that moisture will infiltrate behind the log siding members, or stagnate within each horizontal junction 12, to cause rotting and associated problems. Moreover, due to the engaging nature of the tongue and groove arrangement, an increased width is required in the log siding to accomplish the desired coupling between the vertically adjacent siding members 2. This is especially disadvantageous when constructing such log siding members from wood, wherein a rough sawn board (referred to as a cant) is formed with a wood planar to produce the particular log siding member. In the invention disclosed in FIG. 1, a substantial amount of the cant width is consumed by the required tongue and groove. This effectively reduces the length of the exposed exterior surface, thereby causing the log siding to have a "shallow" outward visual appearance that is less round than is found in a true log construction.

OBJECTS AND SUMMARY OF THE INVENTION

Accordingly, it is a primary object of the present invention to provide an improved log siding having a moisture-proof junction capable of zero moisture infiltration.

It is another object of the present invention to provide an improved log siding which is inexpensive to manufacture and easy to install and maintain.

It is still another object of the present invention to provide an improved log siding which may be composed of a variety of materials, including wood, vinyl, or metal.

It is yet another object of the present invention to provide an improved log siding which is capable of resisting any swelling, warping, and/or cracking due variations in temperature and the moisture content of the log siding.

It is a still another object of the present invention to provide an improved log siding of decreased width, thereby allowing a deeper and more curved exterior surface.

It is another object of the present invention to provide an improved log siding capable of being applied in a blind-nail fashion, with the nails hidden from the viewing surface.

In accordance with a broad aspect of the present invention, an improved log siding system is disclosed for application on the exterior of a structure to provide a simulated log construction. This improved log siding system comprises a plurality of horizontally elongated siding members disposed in vertically adjacent relationship on said exterior of the structure. Each of the siding members has a generally arcuate exterior surface having an upper longitudinal edge and a lower longitudinal edge, an interior surface disposed opposite the exterior surface having an upper longitudinal edge and a lower longitudinal edge, an upper interlocking surface extending between the upper longitudinal edge of the exterior surface and the upper longitudinal edge of the interior surface, and a lower interlocking surface extending between the lower longitudinal edge of the exterior surface and the lower longitudinal edge of the interior surface. The plurality of siding members are disposed on the exterior of the structure such that the upper interlocking surfaces engagedly cooperate with the lower interlocking surfaces such that the lower longitudinal edge of each exterior surface flushingly overlaps the upper longitudinal edge of the exterior surface of an immediately adjacent siding member to form a moisture seal junction therebetween and a flex gap extending between the moisture seal junction and the interior surface. The moisture seal junction prevents the ingress of moisture from the lower longitudinal edge of the exterior surface of each of the plurality of siding members toward each interior surface. The flex gap fluctuates in response to variations in heat, moisture and minute planing irregularities to allow each of the plurality of siding members to flex without breaking the moisture seal junction.

In another broad aspect of the present invention, an improved horizontally elongated siding member is disclosed for use on the exterior of a building to simulate the appearance of log construction. The improved siding member comprises a generally arcuate exterior surface having an upper longitudinal edge and a lower longitudinal edge, an interior surface having an upper longitudinal edge and a lower longitudinal edge, an upper interlocking surface extending between the upper longitudinal edge of the exterior surface and the upper longitudinal edge of the interior surface, and a lower interlocking surface extending between the lower longitudinal edge of the exterior surface and the lower longitudinal edge of the interior surface. The exterior surface has an engagement portion extending from the upper longitudinal edge of the exterior surface a predetermined distance toward the lower longitudinal edge of the exterior surface. The upper interlocking surface has at least one flex gap portion extending inwardly from the upper longitudinal edge of the exterior surface toward the upper longitudinal edge of the interior surface. The lower interlocking surface has an engagement portion and at least one flex gap portion extending inwardly from the engagement portion toward the lower longitudinal edge of the interior surface.

In yet another broad aspect of the present invention, a method is disclosed for providing a moisture-proof log siding for use on the exterior of a building. This method comprises the first step of manufacturing a plurality of horizontally elongated siding members so that each of the plurality of siding members has a generally arcuate exterior surface having an upper longitudinal edge and a lower longitudinal edge, an interior surface having an upper longitudinal edge and a lower longitudinal edge, an upper interlocking surface extending between the upper longitudinal edge of the exterior surface and the upper longitudinal edge of the interior surface, and a lower interlocking surface extending between the lower longitudinal edge of the exterior surface and the lower longitudinal edge of the interior surface. The exterior surface is manufactured with an engagement portion extending from the upper longitudinal edge of the exterior surface a predetermined distance toward the lower longitudinal edge of the exterior surface. The upper interlocking surface is manufactured having at least one flex gap portion extending inwardly from the upper longitudinal edge of the exterior surface toward the upper longitudinal edge of the interior surface. The lower interlocking surface is manufactured having an engagement portion and at least one flex gap portion extending inwardly from the engagement portion toward the lower longitudinal edge of the interior surface. The method comprises the further step of affixing the plurality of siding members to the exterior of the building in vertically adjacent relationship such that the lower longitudinal edge of each exterior surface flushingly overlaps the upper longitudinal edge of each exterior surface of an immediately adjacent siding member to form a moisture seal junction therebetween and a flex gap extending between the moisture seal junction and the interior surface.

DETAILED DESCRIPTION OF THE PREFERRED EMBODIMENTS

The present invention provides an improved log siding for use on the exterior and/or interior of pre-fabricated buildings so as to simulate the outward appearance of a log construction. To do so, the improved log siding of the present invention may be constructed out of wood, plastic, or metal. If a wood construction is desired, the present invention may be manufactured through a single step process whereby a wood planer is used to shape and form a wood plank, referred to as a cant, into the particular embodiments that follow. Similarly, a single step manufacturing process is capable for both plastic or metal construction, whereby the desired shape may be formed by injection molding or bending, respectively. In all cases, the present invention is manufactured to provide a moisture-proof seal between the vertically adjacent log siding members so as to reduce the propensity for moisture to infiltrate into or behind the log siding members to cause swelling, rotting, or cracking with time.

Figure 1:
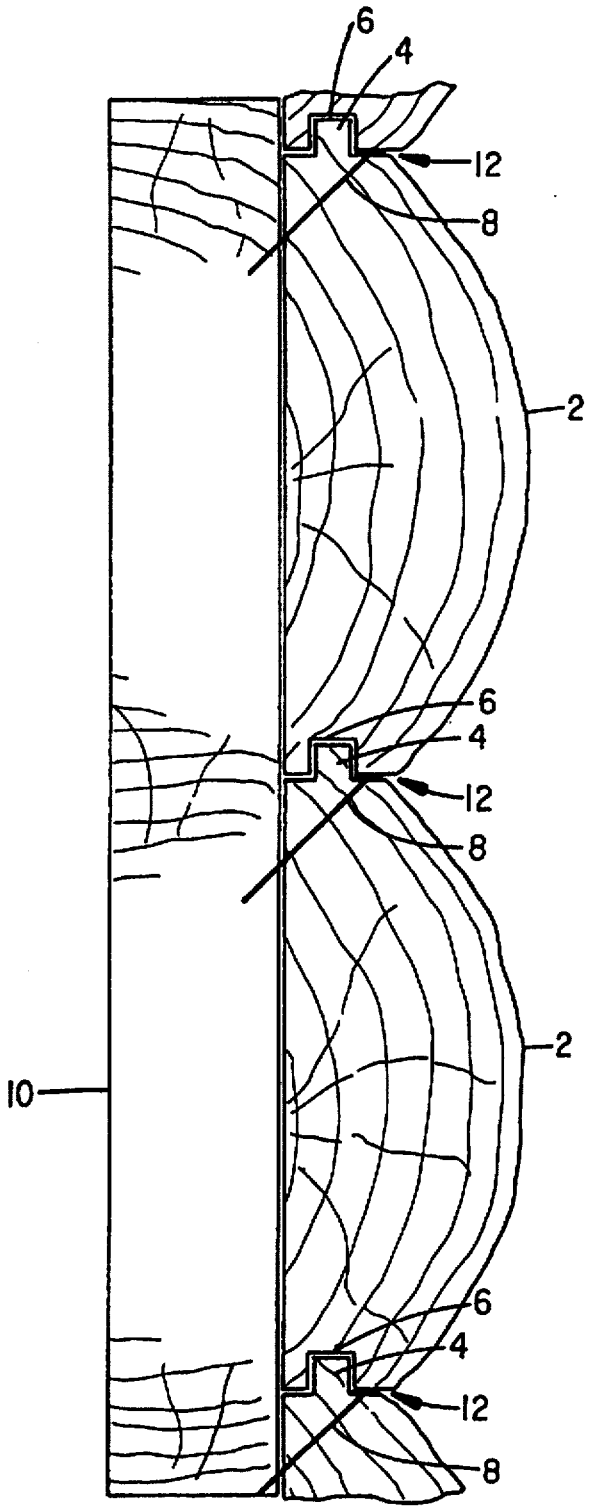
FIG. 1 (PRIOR ART)
FIG. 1 is a cross-sectional view of a prior art log siding system having a traditional tongue and groove interlocking configuration.
Figure 2A:
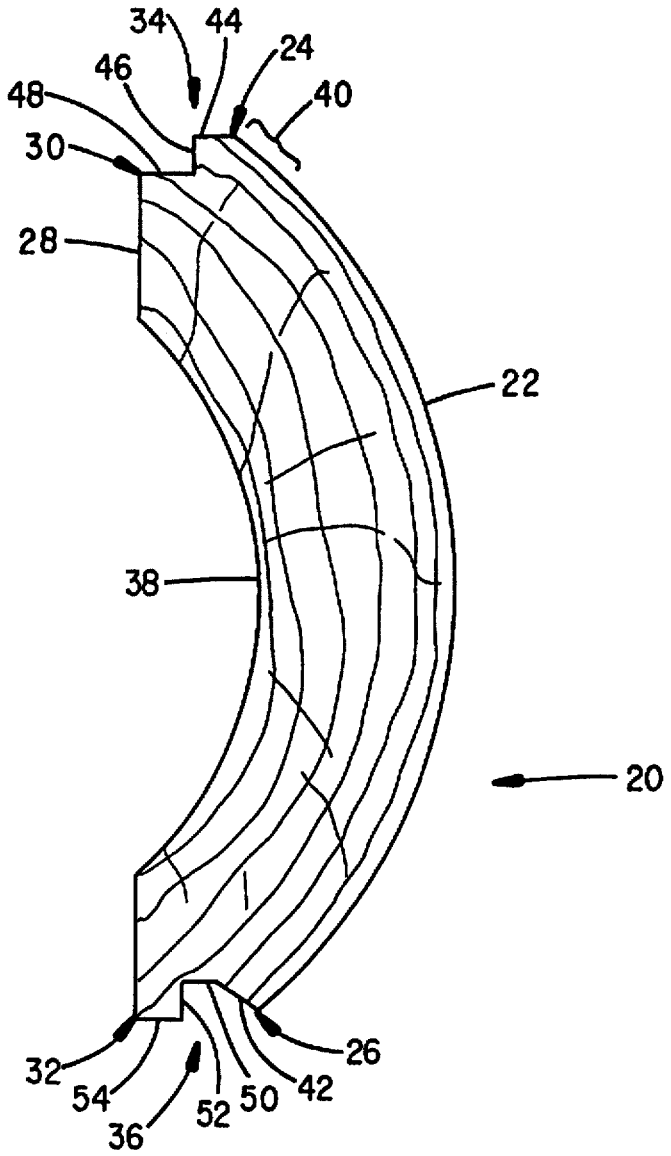
FIG. 2A is a cross-sectional view of a single log siding member in accordance with a first embodiment of the present invention.

Referring first to FIG. 2A, shown is an individual log siding member 20 of a first embodiment of the present invention. Log siding member 20 has a generally arcuate exterior surface 22 simulating a solid log and having an upper outer longitudinal edge 24 and a lower outer longitudinal edge 26. Exterior surface 22 also has an engagement portion, shown enclosed by a bracket 40, extending a predetermined distance along the exterior surface 22 from upper longitudinal edge 24 toward lower longitudinal edge 26. Opposing the exterior surface 22 is a straight, vertical interior surface 28 having an upper longitudinal edge 30 and a lower longitudinal edge 32. An upper interlocking surface, indicated generally by numeral 34, is disposed between upper longitudinal edges 24, 30, while a corresponding lower interlocking surface, shown generally by numeral 36, is disposed between lower longitudinal edges 26, 32. Upper interlocking surface 34 comprises a stair step configuration having a first flex gap surface 44 extending horizontally from upper longitudinal edge 24 toward a vertically disposed third flex gap surface 46. A second flex gap surface 48 extends horizontally from third flex gap surface 46 toward upper longitudinal edge 30.

Lower interlocking surface 36 has an engagement portion 42 and first, second and third flex gap surfaces 50, 54, 52, respectively. Engagement portion 42 extends angularly upward and inward from lower longitudinal edge 26 toward first flex gap surface 50, while third flex gap surface 52 extends vertically downward from first flex gap surface 50 toward second flex gap surface 54. Second flex gap surface 54 extends horizontally from third flex gap surface 52 toward lower longitudinal edge 32, while first flex gap surface 50 extends horizontally from engagement portion 42 toward third flex gap surface 52. Interior surface 28 has a concave release cut 38 disposed in between upper and lower longitudinal edges 30, 32 having generally the same arcuate shape as exterior surface 22.

Figure 2B:
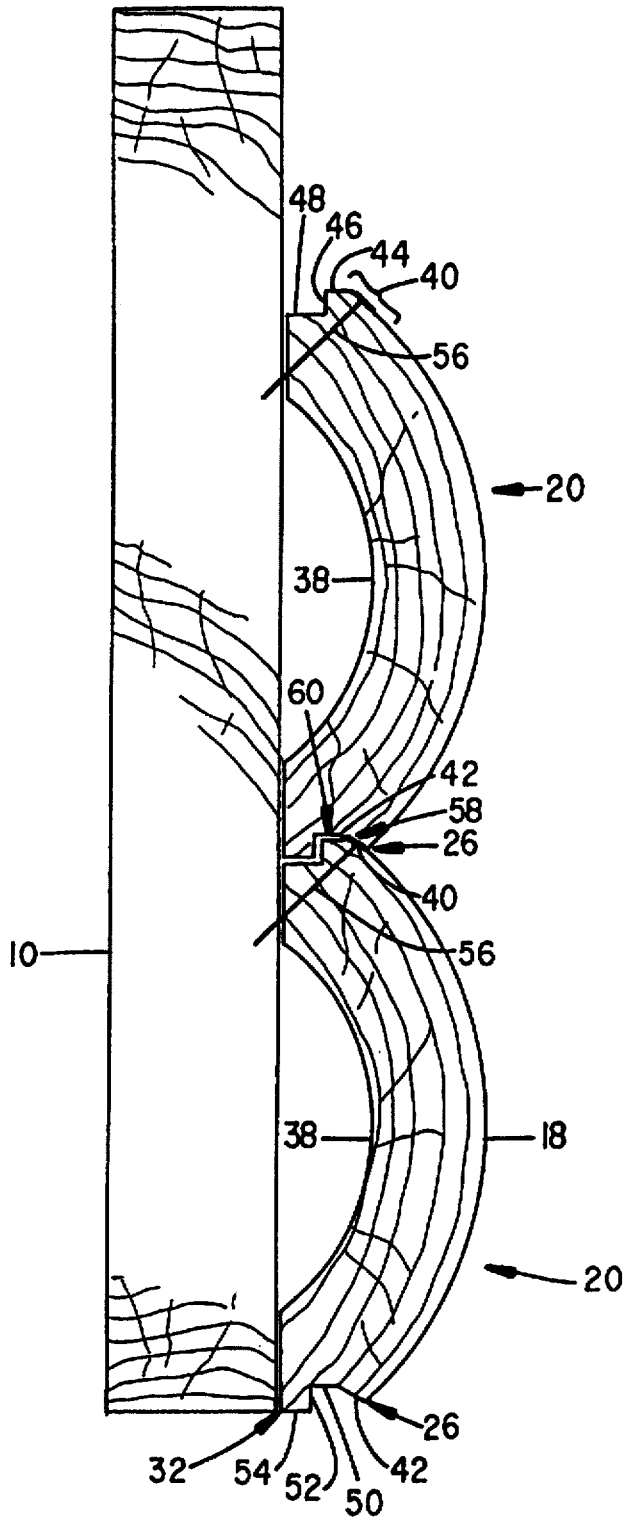
FIG. 2B is a cross-sectional view depicting a plurality of log siding members of the type shown in FIG. 2A applied to a building in vertically adjacent relationship.

Referring now to FIG. 2B, shown is a cross-sectional view of a plurality of siding members 20 affixed in vertically adjacent relationship on the exterior surface of a building 10. To apply siding members 20 in the "blind-nail" fashion as shown, construction starts at the bottom of building 10 and progresses vertically upward, with each log siding member 20 being interlocked with, and affixed above, the previously attached log siding member 20. Nails 56 are driven angularly through engagement portion 40 of each log siding member 20 such that the head of each nail 56 lies flush with the surface of each engagement portion 40. The interlocking relationship of the adjacent log siding members 20 is such that each engagement portion 42 flushingly overlaps the engagement portion 40 of the immediately adjacent siding member 20 to form a moisture seal junction 58 therebetween. In other words, each moisture seal junction 58 is formed between each lower longitudinal edge 26 and the upper longitudinal edge 24 of the immediately adjacent siding member 20. Each nail 56, therefore, is disposed completely within each moisture seal junction 58 so as to provide the "blind-nail" appearance, wherein each nail 56 is hidden from a viewing surface 18 which extends on each exterior surface 22 between the lower longitudinal edges 26 of adjacent log siding members 20.

Also formed by the "blind-nailing" process is a flex gap, shown generally at 60, which extends in a stair step fashion away from moisture seal junction 58 toward building 10. Flex gap 60 comprises the interspacing that results between first, second, and third flex gap surfaces 44, 48, 46 of each upper interlocking surface 34 and first, second, and third flex gap surfaces 50, 54, 52 of the immediately adjacent log siding member 20. The interspacing of flex gap 60 is provided as a buffer which varies in response to swelling or shrinkage which may occur in log siding members 20 due to fluctuations in heat and/or the moisture content of the log siding members 20 due to humidity, or due to minute planing irregularities. Each flex gap 60 thereby maintains the corresponding moisture seal junction 58 in a closed and sealed condition regardless of the aforementioned fluctuations in heat and/or humidity.

Overlapping engagement portions 40, 42 are complimentary in shape such that, when forced together through the "blind-nailing" process, each resulting moisture seal junction 58 is a tight and flush seal to thwart the intrusion of any moisture therebetween. Each moisture seal junction 58 extends angularly upward and inward from each lower longitudinal edge 26 toward each flex gap 60. This upward and inward incline is significant in the prevention of water seepage because, even if moisture infiltrates into a moisture seal junction 58 at the junction of the corresponding lower longitudinal edge 26 and engagement portion 40, the angle will make the moisture combat not only the flush seal of the moisture seal junction 58, but also gravity in order to reach the corresponding flex gap 60 where it could pool. Provided as such, each moisture seal junction 58 ensures that moisture will be effectively repelled from entry into the corresponding flex gap 60. This, in turn, minimizes the risk that moisture will find its way behind log siding members 20 to cause the rotting, swelling or cracking of log siding members 20.

As noted above, flex gaps 60 are provided so as to accept any fluctuations in the size of the log siding members 20 without breaking the seal of the moisture seal junctions 58. As further assurance against such fluctuations in the size of log siding members 20, the present invention is provided with release cuts 38 disposed on the interior surface 28 of each log siding member 20. Release cuts 38 work in conjunction with flex gaps 60 to maintain the flush relationship of each moisture seal junction 58 so that moisture cannot permeate behind the log siding members 20. Release cuts 38 accomplish this in two ways. First, when log siding members 20 are constructed from wood, release cuts 38 reduce the degree to which the log siding members 20 experience stress and/or tension resulting from the planing of the cant to simulate a round-log appearance. This serves to stabilize log siding members 20 to maintain their form following the planing process and to ensure this stability through future cycles of moisture gain and loss within log siding members 20. Second, release cuts 38 reduce the amount of material within log siding members 20, thus dramatically reducing the wood's natural tendency to "check" or crack. By preventing such deformations, the outward visual appearance of the log siding members 20 of the present invention may be maintained for a greater length of time than those log siding systems of the prior art. This results in lower unit cost over the useful lifetime of the siding system of the present invention.

Moreover, when log siding members 20 are constructed of wood, the cants used to produce the log veneer of the present invention may be more narrow in width than the cants used to produce the previously described tongue and groove interlocking configurations of the prior art. This is because the width of the upper and lower interlocking surfaces 34, 36 of the present invention is less than the width of the interlocking surfaces of the tongue and groove log siding of the prior art. For example, with a starting cant width of 3"×8", the interlocking surfaces 34, 36 of the present invention have an approximate width of 23/32 inch, whereas the width of the prior art tongue and groove interlocking surfaces is approximately 1⅛ inch. The interlocking surfaces 34, 36 of the present invention are thus approximately 13/32 inch more narrow than the prior art tongue and groove interlocking surfaces for this particular starting cant size, allowing the log veneer of the present invention to devote a greater amount of the cant width for the width of the exterior surface 22. To illustrate with further reference to a 3"×8" starting cant size, the width of the exterior surface 22 of the present invention is approximately 1 and 29/32 inches, whereas the prior art tongue and groove arrangement results in an exterior surface having a width of approximately 1½ inches. The present invention, therefore, maximizes the width of the exterior surface 22 to produce a deeper and more log-like appearance than is capable with the prior art which employs tongue and groove interlocking surfaces.

In addition to the 3"×8" starting cant size set forth above, the present invention may be constructed from one of a variety of other cant sizes, including but not limited to a 2"×6", 2"×8", 3"×10", 4"×10", and 4"×12" cant size, as well as larger cant sizes. By way of illustration, log siding members 20, when constructed from a 3"×8" starting cant size in accordance with the present invention, have the following approximate specifications: the arcuate length of release cut 38 is 6 inches; the arcuate length of exterior surface 22 is 9 inches; and the width of interlocking surfaces 34, 36 is 23/32 inch. Regardless of the starting cant size, the interspacing of flex gap 60 is approximately 1/16 inch for each embodiment of the present invention.

Figure 3A:
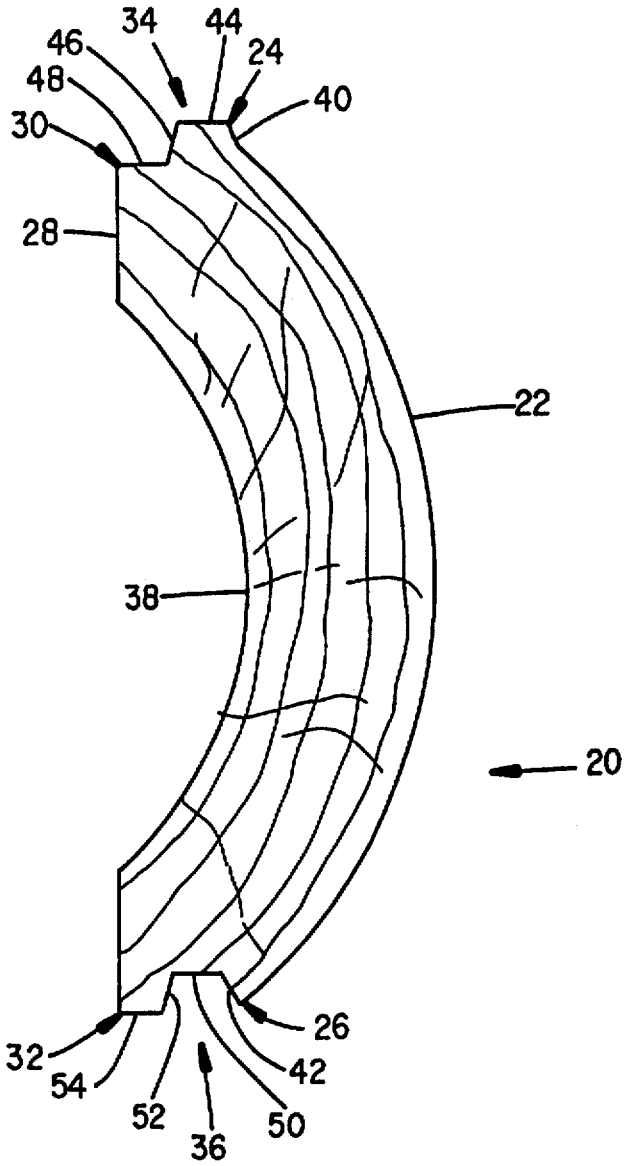
FIG. 3A is cross-sectional view of a single log siding member in accordance with a second embodiment of the present invention.

Referring now to FIG. 3A, shown is a single log siding member of a second embodiment of the present invention. The basic structural components of the log siding member 20 shown in FIG. 3A are the same as found in the embodiment shown in FIG. 2A, with the reference numerals indicating like parts. Accordingly, a description of all said components need not be repeated. Of particular interest in this embodiment is the shape configuration of the upper and lower interlocking surfaces 34, 36, as well as the increased angle of the engagement portion 40. The exterior surface 22 of log siding member 20 maintains a uniform arcuate path from the lower longitudinal edge 26 up until the junction with engagement portion 40. At that point, engagement portion 40 skews away from the arcuate path of exterior surface 22 toward the upper longitudinal edge 24. Engagement portion 40 of this embodiment, therefore, is steeper than the engagement portion 40 of the embodiment shown in FIG. 2A. The same is true for the engagement portion 42 of lower interlocking surface 36. Engagement portion 42 extends at the same steep angle as found in engagement portion 40 from lower longitudinal edge 26 inward and upward toward the first flex gap surface 50 of lower interlocking surface 36. Another distinction of this embodiment is the angled nature of the third flex gap surfaces 46, 52 of upper and lower interlocking surfaces 34, 36, respectively, which extend angularly downward and inward from first flex gap surfaces 44, 50 toward the second flex gap surfaces 48, 54.

Figure 3B:
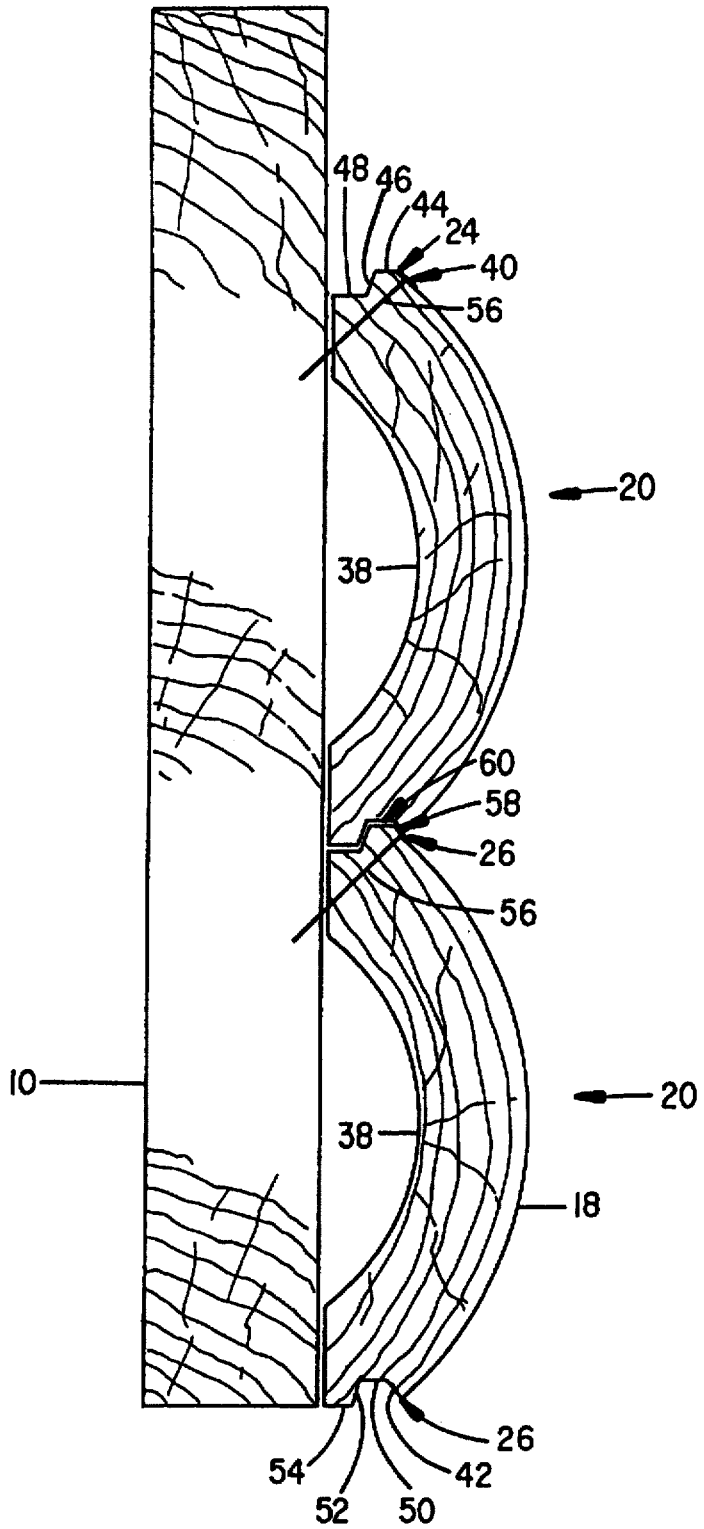
FIG. 3B is a cross-sectional view depicting a plurality of log siding members of the type shown in FIG. 3A applied to a building in vertically adjacent relationship.

Turning now to FIG. 3B, shown are a plurality of log siding members 20 of the type shown in greater detail in FIG. 3A, disposed in vertically adjacent relationship on the exterior surface of building 10. A plurality of nails 56 are used to perform this attachment, with each nail 56 driven angularly through a respective engagement portion 40 into building 10. As in the previous embodiment, the head of each nail 56 is driven so as to be flush with the surface of the respective engagement portion 40. During the bottom-to-top construction as outlined above, the lower interlocking surface 36 of the log siding member 20 currently being applied is positioned in coupling relationship with the upper interlocking surface 34 of the previously attached log siding member 20. In so doing, a moisture seal junction, shown generally at 58, is formed by forcing the complimentary-shaped engagement portions 40, 42 of adjacent log siding members 20 into a flush relationship. Each resulting moisture seal junction 58 completely covers the corresponding nail 56 such that only a uniformly arcuate viewing surface 18, sans nail heads, is visible while looking at the log siding members 20. A flex gap 60 is also formed between each adjacently positioned log siding member 20. As in the previous embodiment, each flex gap 60 extends inward from a respective moisture seal junction 58 toward the building 10.

Functionally, the embodiment shown in FIGS. 3A and 3B performs in the same manner as the embodiment shown in FIGS. 2A and 2B. Each moisture seal junction 58 extends along the flushly positioned engagement portions 40, 42 to provide a water-shed capable of retarding the ingress of moisture into each flex gap 60. The interspacing of each flex gap 60 varies in response to fluctuations in size that log siding members 20 may experience due to variations in moisture content and/or temperature, and minute planing irregularities. This helps maintain the sealing integrity of each moisture seal junction 58 regardless of such fluctuations. The concave release cuts 38 serve this same end by minimizing the degree to which such structural deformities occur by reducing the wood's natural tendency to "check" or crack while stabilizing the log siding members 20 to maintain their original form. When formed from a 3"×8" starting cant size in a planing operation, the width of the interlocking surfaces 34, 36 of the log siding members 20 of this embodiment is approximately 15/16 inch, while the approximate width of the arcuate exterior surface 22 is 1 11/16 inches.

Figure 4A:
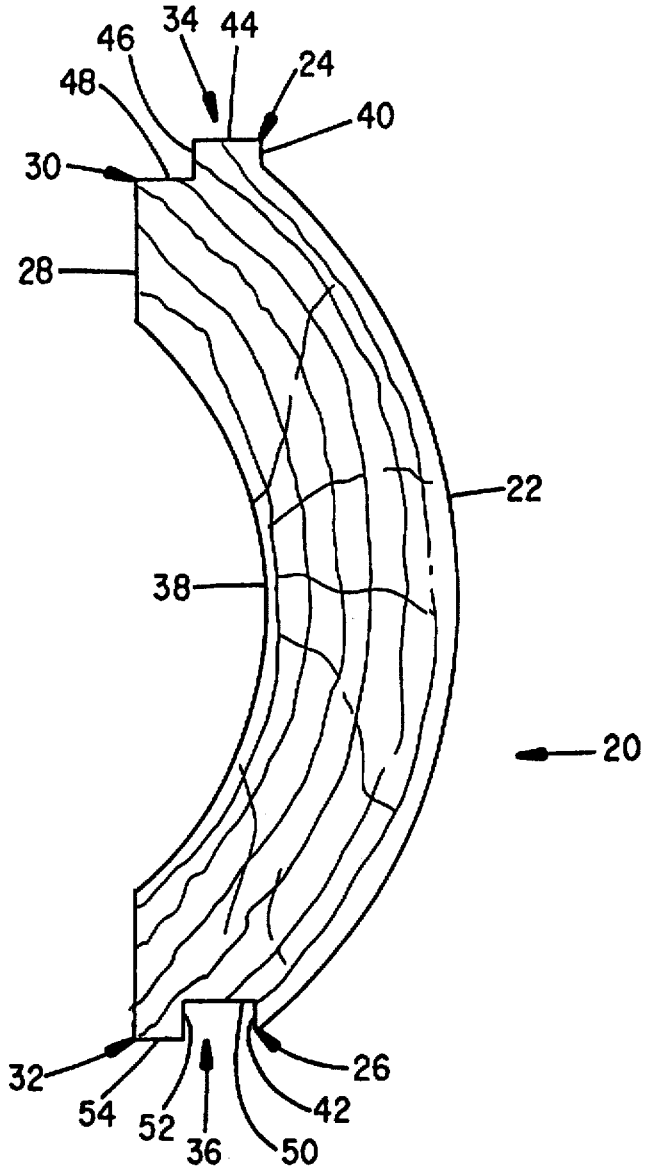
FIG. 4A is a cross-sectional view of a single log siding member in accordance with a third embodiment of the present invention.

Referring now to FIG. 4A, shown is a third embodiment of the present invention. This embodiment is also similar to that disclosed in FIG. 2A, with the notable exception of the particular shape configuration of the engagement portions 40, 42. Engagement portion 40 extends vertically downward along the exterior surface 22 from the upper longitudinal edge 24 a predetermined distance toward the lower longitudinal edge 26. In similar fashion, engagement portion 42 extends vertically upward along the lower interlocking surface 36 from lower longitudinal edge 26 toward a first flex gap surface 50. In all other regards, the structural components of this embodiment are identical to that illustrated in FIG. 2A and, accordingly, a duplicative explanation of such components is not necessary.

Figure 4B:
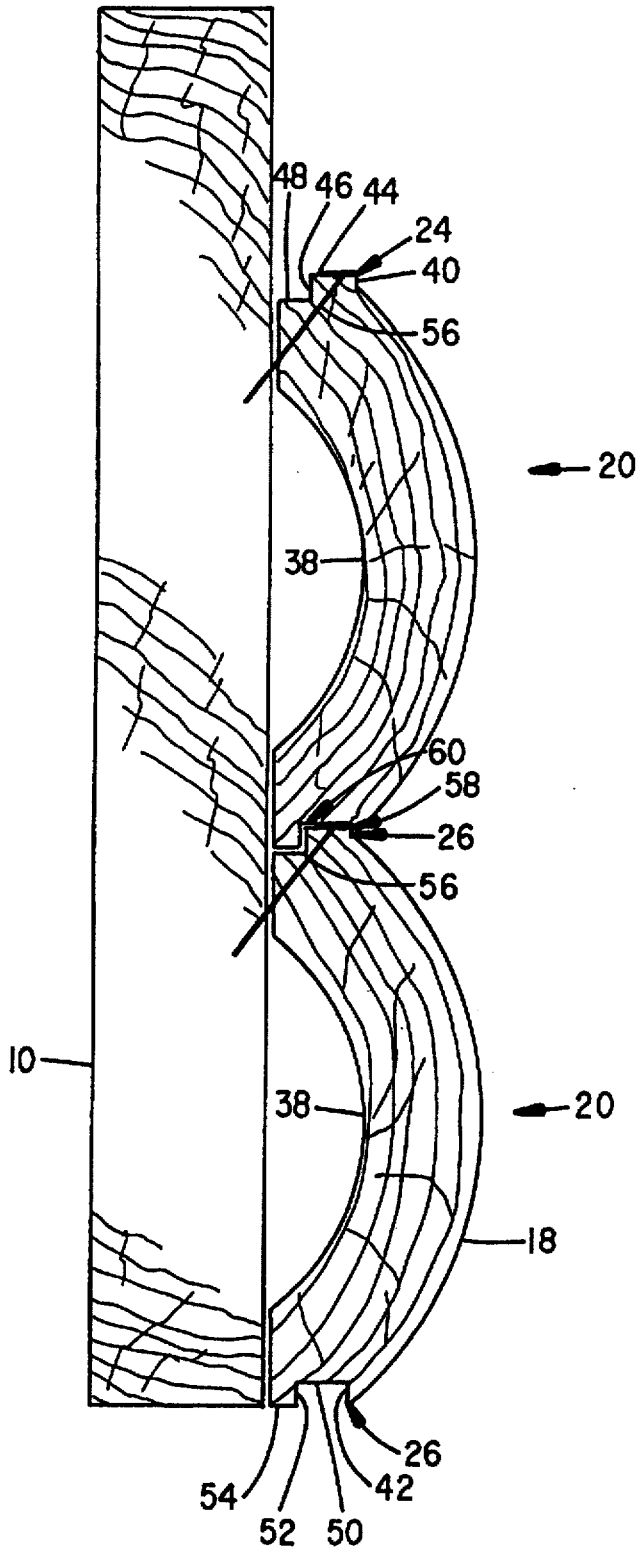
FIG. 4B is a cross-sectional view depicting a plurality of log siding members of the type shown in FIG. 4A applied to a building in vertically adjacent relationship.

With reference now to FIG. 4B, shown are a plurality of log siding members 20 of the type illustrated in FIG. 4A nailed to wall sheathing 10. As in the previous embodiments, log siding members 20 are disposed in vertically adjacent relationship about the exterior of building 10 in "blind-nail" fashion. In this instance, however, each nail 56 is driven through a respective first flex gap surface 44 into attachment with building 10. The head of each nail 56 is driven so as to be flush with the surface of each first flex gap surface 44, thereby allowing the interspacing of each resulting flex gap 60 to vary in response to fluctuations in moisture, temperature, and minute planing irregularities without being hindered by the head of nail 56. This attachment forces the engagement portions 40, 42 of adjacent log siding members 20 to form the flush mating relationship of a moisture seal junction 58. Each moisture seal junction 58 extends vertically from each lower longitudinal edge 26 toward the respective flex gap 60. As such, each moisture seal junction 58 is parallel to the exterior surface of the building 10. This makes it even more difficult for moisture to seep inward toward flex gap 60, thereby decreasing the likelihood of such an ingress of moisture. Starting with a 3"×8" cant size, the resulting width of the interlocking surfaces 34, 36 is $^{31}/_{32}$ inch, while the width of the exterior surface 22 is approximately $1^{21}/_{32}$ inches.

Figure 5A:
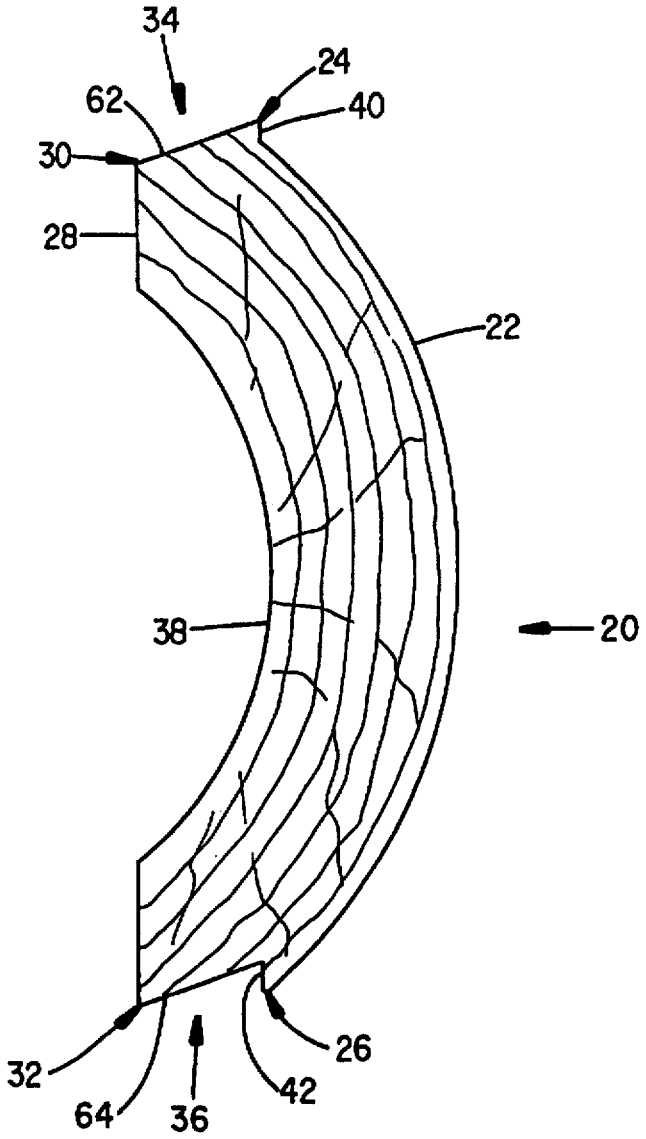
FIG. 5A is a cross-sectional view of a single log siding member in accordance with a fourth embodiment of the present invention.

Referring now to FIG. 5A, shown is a single log siding member 20 of a fourth embodiment of the present invention. This embodiment is similar to that shown in FIG. 4A, with the notable exception of the configuration of the upper and lower interlocking surfaces 34, 36. In this embodiment, however, upper interlocking surface 34 comprises a single flex gap surface 62 which extends angularly downward and inward from upper longitudinal edge 24 toward upper longitudinal edge 30. An engagement portion 40 extends vertically downward along exterior surface 22 a predetermined distance toward lower longitudinal edge 26. Lower interlocking surface 36, being complimentary in shape with engagement portion 40 and upper interlocking surface 34, has an engagement portion 42 extending vertically upward from lower longitudinal edge 26 toward a single flex gap surface 64 which extends angularly downward and inward from engagement portion 42 toward the lower longitudinal edge 32 of interior surface 28.

Figure 5B:
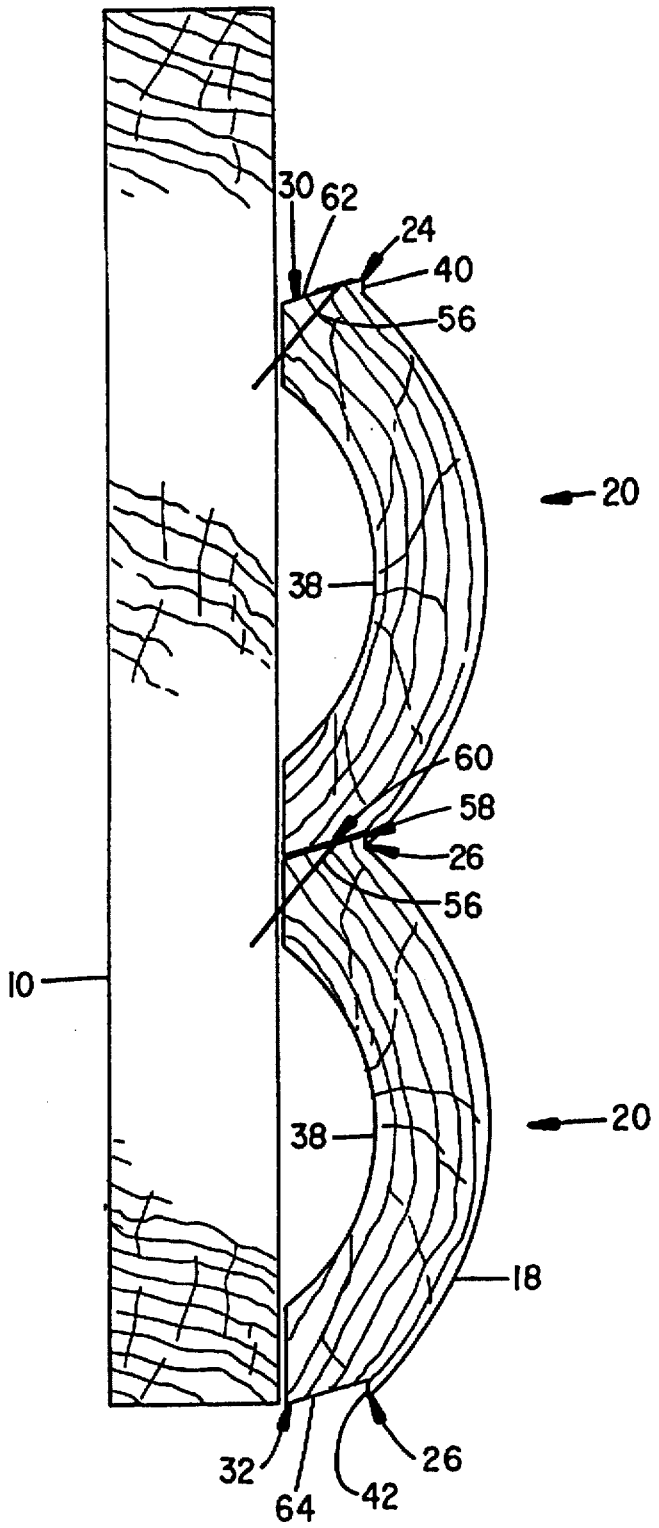
FIG. 5B is a cross-sectional view depicting a plurality of log siding members of the type shown in FIG. 5A applied to a building in vertically adjacent relationship.

Turning to FIG. 5B, shown are a plurality of log siding members 20 of the type detailed in FIG. 5A attached in vertically adjacent relationship to the exterior of the building 10 in "blind-nail" fashion. To accomplish this, the nails 56 are driven angularly into the flex gap surfaces 62 of the upper interlocking surfaces 34 such that the head of each nail 56 is flush with, or below, the surface of the flex gap surface 62. As explained above, this ensures that the interspacing of the resulting flex gap 60 is able to vary in response to swelling and/or shrinking within the log siding members 20. This, of course, serves to maintain the sealing integrity of each moisture seal junction 58 so as to provide the desired water shed regardless of such structural deformations. As in the previous embodiment, planing a cant having a 3"×8" starting size will produce interlocking surfaces 34, 36 with a width of approximately $^{31}/_{32}$ inch and exterior surface 22 with a width of approximately $1^{21}/_{32}$ inches.

Figure 6A:
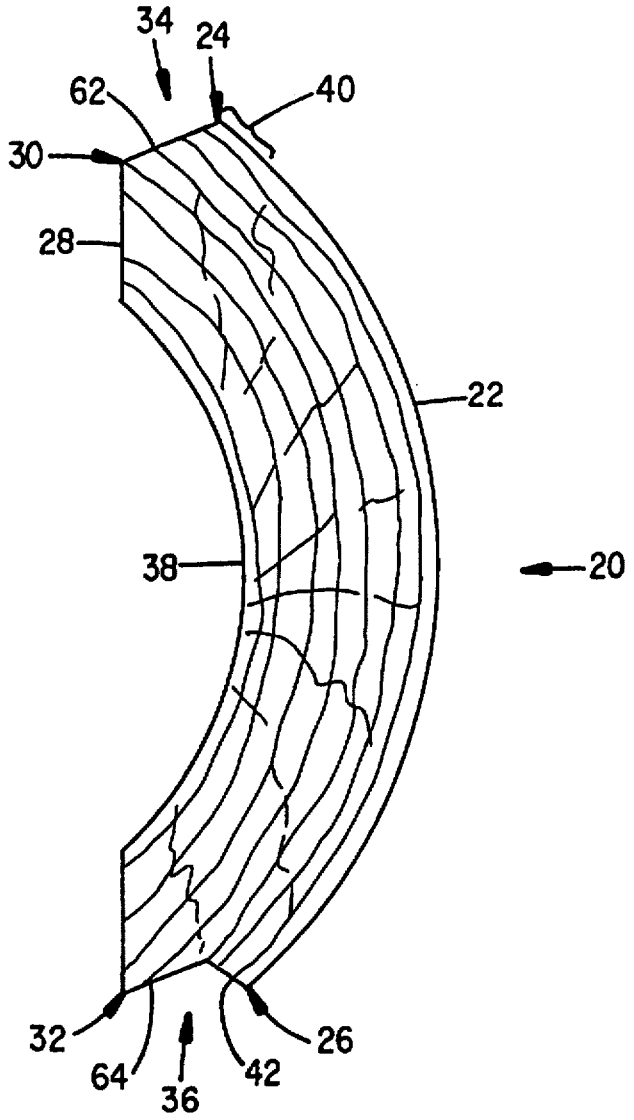
FIG. 6A is a cross-sectional view of a single log siding member in accordance with a fifth embodiment of the present invention.
Figure 6B:
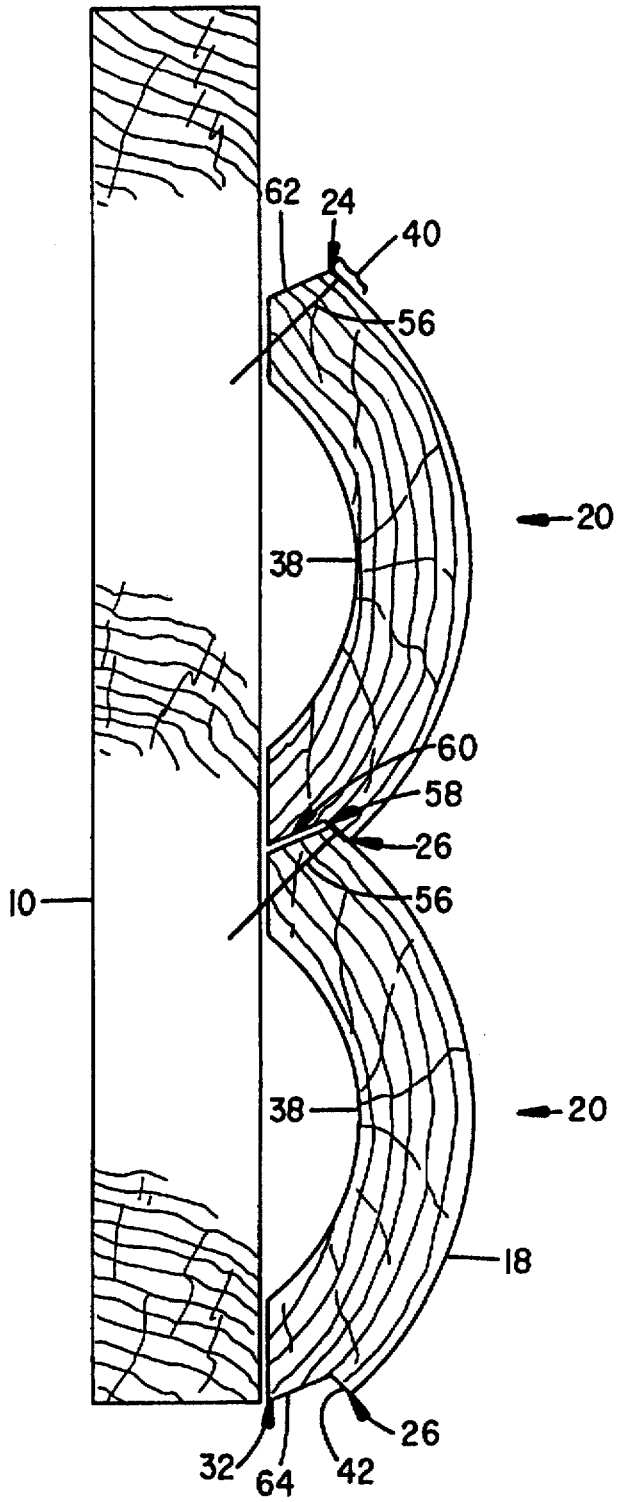
FIG. 6B is a cross-sectional view depicting a plurality of log siding members of the type shown in FIG. 6A applied to a building in vertically adjacent relationship.

Turning now to FIGS. 6A and 6B, shown is a fifth embodiment of a log siding member 20 of the present invention. This embodiment combines the angled engagement portions 40, 42 as found in FIG. 2A with the angular flex gap surfaces 62, 64 as found in FIG. 5A. In this embodiment, a 3"×8" starting cant size will result in interlocking surfaces 34, 36 having a width of approximately $^{23}/_{32}$ inch and exterior surface 22 having an approximate width of $1^{29}/_{32}$ inches. Functionally, the log siding members 20 of this embodiment perform the same desired water-shed as found in the above-mentioned embodiments when attached to the exterior of the building 10 in "blind-nail" fashion. Accordingly, it is not necessary to repeat the explanations set forth above.

Figure 7C:
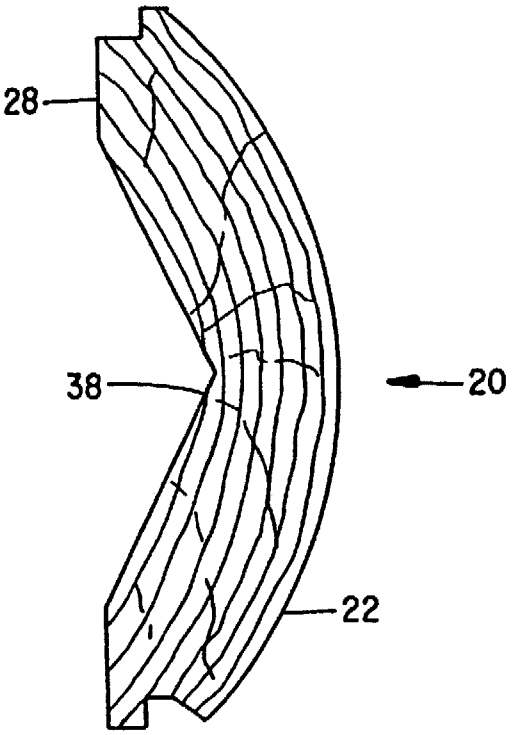
FIGS. 7A–7C depict alternate interior surface configurations for use with the embodiments depicted in FIGS. 2A–6B.
Figure 7B:
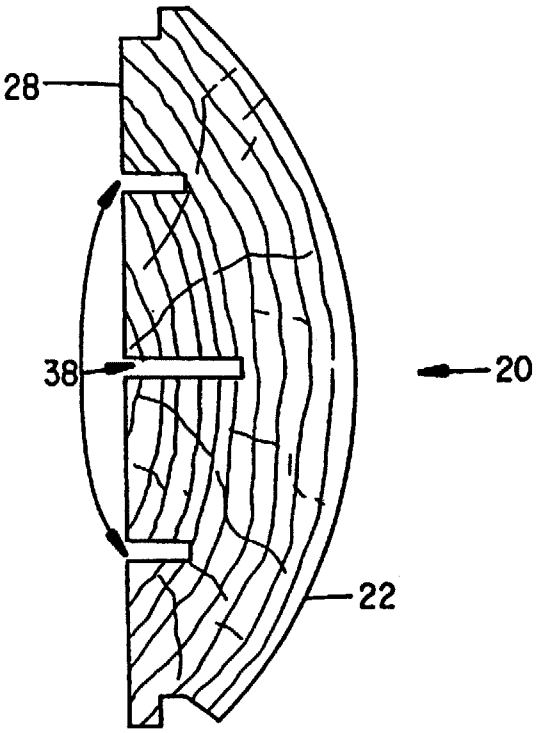
Figure 7A:
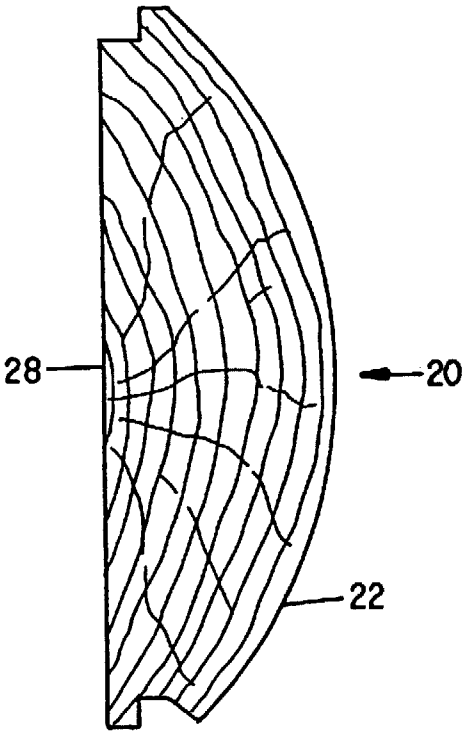

Finally, FIGS. 7A–7C illustrate a variety of interior surface configurations for use with the previously-enumerated embodiments of the present invention. As shown in FIG. 7A, the log siding member 20 may be formed from a cant without any release cut formed in the interior surface 28. The desired water-shed of the present invention is still obtainable with this configuration due to the previously described moisture seal junctions 58 and flex gaps 60 that are formed between each adjacently positioned log siding member 20. FIG. 7B illustrates a plurality of release cuts 38 disposed horizontally within log siding member 20 along the interior surface 28 thereof. Release cuts 38 are formed by removing a predetermined volume of log siding material from the interior surface 28 by any number of well known techniques. This removal reduces the amount of material within log siding member 20 that can experience variations in size, such as swelling, due to fluctuations in moisture content and temperature. Furthermore, this removal of material eliminates the stress and/or tension resulting from the planing of the cants to simulate a round-log appearance, thus stabilizing the log siding members 20 to maintain their original form. Moreover, by removing the material from the interior surface 28 ensures that the "checking" or cracking of the wood log siding member 20 is held to an absolute minimum. Thus, release cuts 38, in conjunction with each flex gap (not shown), serve to maintain the sealing integrity of each moisture seal junction (not shown). Lastly, FIG. 7C illustrates yet another alternate embodiment with a different release cut 38 of the present invention. Release cut 38 is configured in a triangular arrangement to provide the ability to absorb the aforementioned structural deformations in the log siding member 20 due to variations in moisture content and temperature.

The various embodiments of the present invention have been described herein in considerable detail in order to comply with the Patent Statutes and to provide those skilled in the art with the information needed to apply the novel principles and to construct and use such specialized components as are required. It is to be understood that the invention can be carried out by specifically different means and that various modifications can be accomplished without departing from the scope of the invention itself.

What is claimed is:

1. An improved log siding system for application on a surface of a building structure to provide a simulated log construction, comprising:

a plurality of horizontally elongated siding members, each of said siding members including an exterior surface having an upper longitudinal edge and a lower longitudinal edge, an interior surface having an upper longitudinal edge and a lower longitudinal edge, an upper interlocking surface extending between said upper longitudinal edge of said exterior surface and said upper longitudinal edge of said interior surface, and a lower interlocking surface extending between said lower longitudinal edge of said exterior surface and said lower longitudinal edge of said interior surface;

said exterior surface including a substantially non-horizontal engagement portion extending generally downwardly from said upper longitudinal edge of said exterior surface, and a generally arcuate viewing portion extending between said engagement portion and said lower longitudinal edge of said exterior surface; and said lower interlocking surface including a substantially non-horizontal engagement portion extending generally upwardly from said lower longitudinal edge of said exterior surface;

whereby said plurality of siding members are disposed in vertically adjacent fashion on a surface of a building structure such that said engagement portion of said exterior surface and said engagement portion of said lower interlocking surface matingly engage to form a flush and substantially non-horizontal moisture seal junction extending generally upwardly from said viewing portion of said exterior surface, and such that said upper and lower interlocking surfaces cooperate to form a flex gap extending between said moisture seal junction and said interior surface, said moisture seal junction serving to inhibit the ingress of moisture from said viewing portion of said exterior surface toward said flex gap, and said flex gap permitting adjacently disposed siding members to flex in response to fluctuations in heat, moisture, and minute planing irregularities while maintaining said moisture seal junction.

2. The improved log siding system as set forth in claim 1 and further, wherein said engagement portion of each said exterior surface and said engagement portion of each said lower interlocking surface are configured such that said moisture seal junction extends angularly upward and inward from said said viewing portion of each of said plurality of siding members toward each said flex gap, and wherein each said interior surface has at least one release cut disposed between said upper and lower longitudinal edges of each said interior surface.

3. The improved log siding system as set forth in claim 2 and further, wherein said engagement portion of each said exterior surface and said engagement portion of each said lower interlocking surface are configured such that said moisture seal junction extends angularly inward and upward from said viewing portion of each of said plurality of siding members toward each said flex gap along the same arcuate path as said viewing portion.

4. The improved log siding system as set forth in claim 3 and further, wherein each said flex gap comprises:

a first gap area, a second gap area, and a third gap area extending therebetween;

said first gap area extending horizontally inward from said moisture seal junction toward said third gap area;

said third gap area extending downward from said first gap area toward said second gap area; and said second gap area extending horizontally inward from said third gap area toward said interior surface.

5. The improved log siding system as set forth in claim 4 and further, wherein said plurality of siding members are attached to said surface of said building structure with a plurality of attachment means, each of said plurality of attachment means being driven angularly into said engagement portion of said exterior surface of each of said plurality of siding members such that said attachment means is not visible on said viewing portion of said exterior surface.

6. The improved log siding system as set forth in claim 3 and further, wherein said flex gap extends angularly downward and inward from said moisture seal junction toward said interior surface.

7. The improved log siding system as set forth in claim 6 and further, wherein said plurality of siding members are attached to said surface of said building structure with a plurality of attachment means, each of said plurality of attachment means being driven angularly into said engagement portion of said exterior surface of each of said plurality of siding members such that said attachment means is not visible on said viewing portion of said exterior surface.

8. The improved log siding system as set forth in claim 2 and further, wherein said engagement portion of each said exterior surface and said engagement portion of each said lower interlocking surface are configured such that said moisture seal junction extends angularly inward and upward from said viewing portion of each of said plurality of siding members toward each said flex gap along an angular path that is steeper than the arcuate path of said viewing portion.

9. The improved log siding system as set forth in claim 8 and further, wherein each said flex gap comprises:

a first gap area, a second gap area, and a third gap area extending therebetween;

said first gap area extending horizontally inward from said moisture seal junction toward said third gap area;

said third gap area extending downward from said first gap area toward said second gap area; and said second gap area extending horizontally inward from said third gap area toward said interior surface.

10. The improved log siding system as set forth in claim 9 and further, wherein said plurality of siding members are attached to said surface of said building structure with a plurality of attachment means, each of said plurality of attachment means being driven angularly into said engagement portion of said exterior surface of each of said plurality of siding members such that said attachment means is not visible on said viewing portion of said exterior surface.

11. The improved log siding system as set forth in claim 1 and further, wherein said engagement portion of each said exterior surface and said engagement portion of each said lower interlocking surface are configured such that said moisture seal junction extends vertically upward from said lower longitudinal edge of said exterior surface of each of said plurality of siding members toward each said flex gap, and wherein each said interior surface has at least one release cut disposed between said upper and lower longitudinal edges of each said interior surface.

12. The improved log siding system as set forth in claim 11 and further, wherein each said flex gap comprises:

a first gap area, a second gap area, and a third gap area extending therebetween;

said first gap area extending horizontally inward from said moisture seal junction toward said third gap area;

said third gap area extending downward from said first gap area toward said second gap area; and said second gap area extending horizontally inward from said third gap area toward said interior surface.

13. The improved log siding system as set forth in claim 12 and further, wherein said plurality of siding members are attached to said surface of said building structure with a plurality of attachment means, each of said plurality of attachment means being driven angularly into said engagement portion of said exterior surface of each of said plurality of siding members such that said attachment means is not visible on said viewing portion of said exterior surface.

14. The improved log siding system as set forth in claim 11 and further, wherein said flex gap extends angularly downward and inward from said moisture seal junction toward said interior surface.

15. The improved log siding system as set forth in claim 14 and further, wherein said plurality of siding members are attached to said surface of said building structure with a plurality of attachment means, each of said plurality of attachment means being driven angularly into said engagement portion of said exterior surface of each of said plurality of siding members such that said attachment means is not visible on said viewing portion of said exterior surface.

16. An improved horizontally elongated siding member for use on a surface of a building to simulate the appearance of log construction, comprising:

an exterior surface having an upper exterior longitudinal edge, a lower exterior longitudinal edge, an upper engagement portion extending in a substantially non-horizontal fashion generally downwardly from said upper exterior longitudinal edge along said exterior surface and a generally arcuate viewing portion extending between said upper engagement portion and said lower exterior longitudinal edge;

an interior surface having an upper interior longitudinal edge and a lower interior longitudinal edge, and at least one release cut disposed between said upper interior longitudinal edge and said lower interior longitudinal edge;

an upper interlocking surface extending between said upper exterior longitudinal edge and said upper interior longitudinal edge, said upper interlocking surface including at least one upper flex gap portion extending inward from said upper exterior longitudinal edge toward said upper interior longitudinal edge; and a lower interlocking surface extending between said lower exterior longitudinal edge and said lower interior longitudinal edge, said lower interlocking surface including a lower engagement portion extending generally upwardly from said lower exterior longitudinal edge in approximately the same non-horizontal fashion as said upper engagement portion, and at least one lower flex gap portion extending inward from said lower engagement portion toward said lower interior longitudinal edge;

whereby said lower engagement portion may be flushingly mated with said upper engagement portion of a vertically adjacent siding member to form a substantially non-horizontal moisture seal junction therebetween and at least one flex gap extending inwardly therefrom, said moisture seal junction extending in a substantially non-horizontal fashion from said viewing portion to prohibit the ingress of moisture from said viewing portion.

17. The improved siding member as set forth in claim 16 and further, said upper engagement portion extending angularly upward and inward from said viewing portion toward said at least one upper flex gap portion, and said lower engagement portion extending angularly upward and inward from said lower exterior longitudinal edge toward said at least one lower flex gap portion.

18. The improved siding member as set forth in claim 17 and further, said upper engagement portion extending angularly upward and inward from said viewing portion toward said at least one upper flex gap portion along approximately the same arcuate path as said viewing portion, and said lower engagement portion extending angularly upward and inward from said lower exterior longitudinal edge toward said at least one lower flex gap portion along approximately the same arcuate path as said upper engagement portion.

19. The improved siding member as set forth in claim 18 and further, wherein said at least one upper flex gap portion of said upper interlocking surface comprises:

a first flex gap surface, a second flex gap surface, and a third flex gap surface extending therebetween;

said first flex gap surface extending horizontally inward from said upper exterior longitudinal edge toward said third flex gap surface;

said third flex gap surface extending downward from said first flex gap surface toward said second flex gap surface; and said second flex gap surface extending horizontally inward from said third flex gap surface toward said upper interior longitudinal edge.

20. The improved siding member as set forth in claim 19 and further, wherein said at least one lower flex gap portion of said lower interlocking surface comprises:

a first flex gap surface, a second flex gap surface, and a third flex gap surface extending therebetween;

said first flex gap surface extending horizontally inward from said lower engagement portion toward said third flex gap surface;

said third flex gap surface extending downward from said first flex gap surface toward said second flex gap surface; and said second flex gap surface extending horizontally inward from said third flex gap surface toward said lower interior longitudinal edge.

21. The improved siding member as set forth in claim 18 and further, wherein said at least one upper flex gap portion of said upper interlocking surface comprises a single flex gap surface extending angularly downward and inward from said upper exterior longitudinal edge toward said upper interior longitudinal edge, and wherein said at least one lower flex gap portion of said lower interlocking surface comprises a single flex gap surface extending angularly downward and inward from said lower engagement portion toward said lower interior longitudinal edge.

22. The improved siding member as set forth in claim 16 and further, said upper engagement portion extending angularly upward and inward from said viewing portion toward said upper exterior longitudinal edge along an angular path that is steeper than the arcuate path of said viewing portion, and wherein said lower engagement portion extends angularly upward and inward from said lower exterior longitudinal edge toward said at least one lower flex gap portion along approximately the same arcuate path as said upper engagement portion.

23. The improved siding member as set forth in claim 22 and further, wherein said at least one upper flex gap portion of said upper interlocking surface comprises:

a first flex gap surface, a second flex gap surface, and a third flex gap surface extending therebetween;

said first flex gap surface extending horizontally inward from said upper exterior longitudinal edge toward said third flex gap surface;

said third flex gap surface extending downward from said first flex gap surface toward said second flex gap surface; and said second flex gap surface extending horizontally inward from said third flex gap surface toward said upper interior longitudinal edge.

24. The improved siding member as set forth in claim 23 and further, wherein said at least one lower flex gap portion of said lower interlocking surface comprises:

a first flex gap surface, a second flex gap surface, and a third flex gap surface extending therebetween;

said first flex gap surface extending horizontally inward from said lower engagement portion toward said third flex gap surface;

said third flex gap surface extending downward from said first flex gap surface toward said second flex gap surface; and said second flex gap surface extending horizontally inward from said third flex gap surface toward said lower interior longitudinal edge.

25. The improved siding member as set forth in claim 16 and further, said upper engagement portion extending vertically upward from said viewing portion toward said upper exterior longitudinal edge, and said lower engagement portion extending vertically upward from said lower exterior longitudinal edge toward said at least one lower flex gap portion.

26. The improved siding member as set forth in claim 25 and further, wherein said at least one upper flex gap portion of said upper interlocking surface comprises:

a first flex gap surface, a second flex gap surface, and a third flex gap surface extending therebetween;

said first flex gap surface extending horizontally inward from said upper exterior longitudinal edge toward said third flex gap surface;

said third flex gap surface extending downward from said first flex gap surface toward said second flex gap surface; and said second flex gap surface extending horizontally inward from said third flex gap surface toward said upper interior longitudinal edge.

27. The improved siding member as set forth in claim 23 and further, wherein said at least one lower flex gap portion of said lower interlocking surface comprises:

a first flex gap surface, a second flex gap surface, and a third flex gap surface extending therebetween;

said first flex gap surface extending horizontally inward from said lower engagement portion of said lower interlocking surface toward said third flex gap surface;

said third flex gap surface extending downward from said first flex gap surface toward said second flex gap surface; and said second flex gap surface extending horizontally inward from said third flex gap surface toward said lower interior longitudinal edge.

28. The improved siding member as set forth in claim 25 and further, said at least one upper flex gap portion of said upper interlocking surface comprising a single flex gap surface extending angularly downward and inward from said upper exterior longitudinal edge toward said upper interior longitudinal edge, and said at least one lower flex gap portion of said lower interlocking surface comprising a single flex gap surface extending angularly downward and inward from said lower engagement portion toward said lower interior longitudinal surface.

29. A method of providing a moisture-proof log siding for use on a surface of a building, comprising the steps of:

(a) manufacturing a plurality of horizontally elongated siding members so that each of said plurality of siding members includes an exterior surface having an upper longitudinal edge and a lower longitudinal edge, an interior surface having an upper longitudinal edge and a lower longitudinal edge, an upper interlocking surface extending between said upper longitudinal edge of said exterior surface and said upper longitudinal edge of said interior surface, and a lower interlocking surface extending between said lower longitudinal edge of said exterior surface and said lower longitudinal edge of said interior surface, said exterior surface having a substantially non-horizontal upper engagement portion extending generally downwardly from said upper longitudinal edge of said exterior surface and a viewing portion extending in a generally arcuate fashion between said upper engagement portion and said lower longitudinal edge of said exterior surface, said lower interlocking surface including a substantially non-horizontal lower engagement portion extending generally upwardly from said lower longitudinal edge of said exterior surface and at least one flex gap portion extending inward from said lower engagement portion toward said lower longitudinal edge of said interior surface, and said upper interlocking surface including at least one flex gap portion extending inward from said upper longitudinal edge of said exterior surface toward said upper longitudinal edge of said interior surface; and (b) affixing said plurality of siding members to a surface of a building in vertically adjacent relationship such that said upper engagement portion of said exterior surface flushingly engages with said lower engagement portion of said lower interlocking surface of an immediately adjacent siding member to form a substantially non-horizontal moisture seal junction extending generally upwardly from said viewing portion and a flex gap extending between said moisture seal junction and said interior surface.

30. The method as set forth in claim 29 and further, wherein step (a) comprises the further step of providing at least one release cut in said interior surface of each of said plurality of siding members.

31. The method as set forth in claim 30, wherein step (b) further comprises the steps of:

(a) providing a plurality of attachment means for attaching said plurality of siding members to said surface of said building; and (b) driving a quantity of said plurality of attachment means angularly through said upper engagement portion of said upper interlocking surface of each of said plurality of siding members such that each of said plurality of said attachment means is not visible on said viewing portion of each said exterior surface.

* * * * *